US010722093B2

(12) United States Patent
Tuman et al.

(10) Patent No.: US 10,722,093 B2
(45) Date of Patent: Jul. 28, 2020

(54) CLEANING ARTICLE

(71) Applicant: 3M INNOVATIVE PROPERTIES COMPANY, St. Paul, MN (US)

(72) Inventors: Scott J. Tuman, Woodbury, MN (US); Sara R. Amys, Oak Park Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 650 days.

(21) Appl. No.: 15/105,866

(22) PCT Filed: Dec. 17, 2014

(86) PCT No.: PCT/US2014/070895
§ 371 (c)(1),
(2) Date: Jun. 17, 2016

(87) PCT Pub. No.: WO2015/095350
PCT Pub. Date: Jun. 25, 2015

(65) Prior Publication Data

US 2016/0309979 A1 Oct. 27, 2016

Related U.S. Application Data

(60) Provisional application No. 61/917,680, filed on Dec. 18, 2013.

(51) Int. Cl.
*A47L 13/20* (2006.01)
*A47L 13/16* (2006.01)

(52) U.S. Cl.
CPC ..... *A47L 13/20* (2013.01); *A47L 13/16* (2013.01)

(58) Field of Classification Search
CPC . A47L 13/20; D04H 13/02; Y10T 428/24314; Y10T 442/184;
(Continued)

(56) References Cited

U.S. PATENT DOCUMENTS 3,985,599 A 10/1976 Lepoutre
3,985,600 A 10/1976 Blais
(Continued)

FOREIGN PATENT DOCUMENTS

EP 0191355 8/1986
EP 0945251 9/1999
(Continued)

OTHER PUBLICATIONS

Pocius, Adhesion and Adhesives Technology: An Introduction, 216-245 (1997).
(Continued)

*Primary Examiner* — Jennifer A Steele

(57) ABSTRACT

The disclosed cleaning article includes a working surface made from first ends of a plurality of channels and a capturing surface. The channels are formed from multiple strands of a skip-slit sheet, which in an initial state extend in a first direction and together define a plane. The multiple strands are attached to each other at bridging regions. At least some of the strands are spread from the initial state and separated from each other between the bridging regions to provide the plurality of channels, and at least some of the strands that are separated from each other are twisted out of the plane. A cleaning tool including the cleaning article, a method of making the cleaning tool, and a stack of skip-slit spunbond nonwoven sheets are also disclosed.

20 Claims, 5 Drawing Sheets

(58) Field of Classification Search
CPC ..... Y10T 156/1015; Y10T 156/1056; Y10T 428/24298; Y10T 428/24686; Y10T 442/651; B32B 5/022; B32B 5/18; B32B 2432/00; D10B 2403/0213; D10B 2403/0223
See application file for complete search history.

(56) References Cited

U.S. PATENT DOCUMENTS 4,001,366 A 1/1977 Brumlik
4,215,682 A 8/1980 Kubik
4,271,640 A * 6/1981 Gadbois ..... A47L 11/164 15/209.1
4,288,884 A * 9/1981 Bahls ..... A47L 13/20 15/229.2
4,294,240 A 10/1981 Thill
4,375,718 A 3/1983 Wadsworth
4,560,372 A 12/1985 Pieniak
4,592,815 A 6/1986 Nakao
4,676,784 A 6/1987 Erdman
4,874,659 A 10/1989 Ando
4,969,970 A 11/1990 Suzuki
5,232,533 A 8/1993 Tani
5,290,377 A 3/1994 Aihara
5,397,316 A 3/1995 LaVon
5,401,446 A 3/1995 Tsai
5,538,778 A 7/1996 Hurwitz
5,611,790 A 3/1997 Osborn, III
5,628,097 A 5/1997 Benson
5,638,569 A * 6/1997 Newell ..... A47L 13/20 15/228
5,667,871 A 9/1997 Goodrich
5,713,881 A 2/1998 Rezai
5,782,735 A 7/1998 Goodrich
5,791,030 A 8/1998 Aihara et al.
5,868,724 A 2/1999 Dierckes, Jr.
5,904,793 A 5/1999 Gorman
6,093,870 A 7/2000 Carlsson
6,262,331 B1 7/2001 Nakahata
6,531,207 B1 3/2003 Eaton
6,684,445 B1 2/2004 Rios
6,685,274 B1 2/2004 Rios
6,716,514 B2 4/2004 Nissing
6,849,142 B1 2/2005 Goulait
6,865,765 B2 3/2005 Aalbers
7,001,475 B2 2/2006 Ausen
7,014,906 B2 3/2006 Tuman
7,033,965 B2 * 4/2006 Takabayashi ..... A47L 13/16 15/208
7,407,496 B2 8/2008 Petersen
7,643,243 B2 1/2010 Lee
7,691,760 B2 4/2010 Bergsten
7,695,799 B2 4/2010 Cree
7,757,334 B2 7/2010 Patel
7,855,316 B2 12/2010 Meyer
8,020,262 B2 9/2011 Oertel
9,138,031 B2 9/2015 Wood
9,138,957 B2 9/2015 Wood
9,649,824 B2 5/2017 Chandrasekaran
2002/0112325 A1 8/2002 Keohan
2003/0008106 A1 1/2003 Guenther
2003/0130644 A1 7/2003 Baker
2004/0031504 A1 * 2/2004 Stelcher ..... A47L 25/005 134/6
2004/0147890 A1 7/2004 Nakahata et al.
2004/0209042 A1 10/2004 Peacock
2005/0123720 A1 6/2005 Suzuki et al.
2007/0050934 A1 * 3/2007 Yamada ..... A47L 13/16 15/227
2007/0107571 A1 5/2007 Saeki
2007/0136967 A1 6/2007 Tochacek
2007/0207286 A1 * 9/2007 Craig ..... A47L 23/266 428/89
2009/0144923 A1 6/2009 Tuman
2010/0044909 A1 2/2010 Haskett
2010/0100022 A1 4/2010 Greener
2010/0179463 A1 7/2010 Greener
2011/0277258 A1 * 11/2011 Otsuka ..... A47L 13/16 15/209.1
2012/0011685 A1 1/2012 Rocha
2012/0086145 A1 4/2012 Nakamura
2012/0330266 A1 12/2012 Zonneveld

FOREIGN PATENT DOCUMENTS

GB 2017485 10/1979
JP H04-276228 10/1992
JP 2009-240561 10/2009
JP 2013027682 7/2013
WO WO 1996-10481 4/1996
WO Wo 2013-070522 5/2013

OTHER PUBLICATIONS

International Search Report for PCT International Application No. PCT/US2014/070895, dated Apr. 8, 2015, 3pgs.

* cited by examiner

CLEANING ARTICLE

CROSS-REFERENCE TO RELATED APPLICATION

This application claims priority to U.S. Provisional Application No. 61/917,680, filed Dec. 18, 2013, the disclosure of which is incorporated by reference in its entirety herein.

BACKGROUND

Cloths, wipes, brooms and mops are used to wipe and clean surfaces covered with dirt, dust, and debris. Typically, most cloths and wipes do not have the ability to effectively capture and retain small and large particles of dirt and debris. Cleaning sheets such as shown in U.S. Pat. No. 7,691,760 (Bergsten et al.) have been developed to include an adhesive on the working surface of the cleaning sheet to help retain particles of dirt and debris.

Many times cleaning sheets are too flat over the surface being cleaned and therefore only the leading edge of the cleaning sheet will load with material. A variety of techniques have been disclosed to raise portions of the cleaning sheet or to have recessed portions of the cleaning sheet to more effectively get dirt, dust and debris to be captured and retained across the working surface; see, e.g., U.S. Pat. No. 7,757,334 (Patel et al.) and U.S. Pat. Appl. Pub. Nos. 2007-0136967 (Tochacek et al.) and 2009-0144923 (Tuman et al.). Even with raised or recessed portion, the dirt, dust, and debris still accumulate at a leading edge of the sheet or the raised portions. There remains a need for a cleaning sheet to capture higher amounts of dirt, dust and debris.

SUMMARY

The present disclosure relates to a cleaning article. In particular, the present disclosure relates to a cleaning article that includes a skip-slit sheet that is spread open to provide channels at the working surface. The cleaning article also includes a surface for capturing debris.

In one aspect, the present disclosure provides a cleaning article that includes a working surface and a capturing surface. The working surface includes first ends of a plurality of channels. The capturing surface typically is included in at least one of a capturing layer opposite the working surface or within a portion of the interior of the channels. The channels are formed from multiple strands of a skip-slit sheet, which in an initial state extend in a first direction and together define a plane. The multiple strands are attached to each other at bridging regions that are staggered in a second direction transverse to the first direction. At least some of the strands are spread from the initial state and separated from each other between the bridging regions to provide the plurality of channels, and at least some of the strands that are separated from each other are twisted out of the plane.

In another aspect, the present disclosure provides a cleaning tool comprising a surface and the cleaning article described above attached to the surface.

In another aspect, the present disclosure provides a method of making such a cleaning tool. The method includes providing a skip-slit sheet having a plurality of interrupted slits extending in a first direction that are interrupted by intact bridging regions in the skip-slit sheet, providing a cleaning tool having a surface, spreading the skip-slit sheet in a second direction transverse to the first direction to provide multiple strands of the skip-slit sheet separated from each other between the intact bridging regions, and attaching the multiple strands to the surface of the cleaning tool. The intact bridging regions in the skip-slit sheet are staggered in a second direction, and the skip-slit sheet in its initial state before spreading defines a plane. Attaching the multiple strands to the surface of the cleaning tool is carried out such that at least a portion of the multiple strands that are separated from each other are twisted out of the plane defined by the skip-slit sheet before it is spread in the second direction.

The disclosed cleaning article typically has effective debris pick-up, good retention of debris, and low drag on a surface to be cleaned. It can also be made from low-cost materials using low-cost processes. It is believed that the first edges of the plurality of channels at the working surface of the cleaning article serve as miniature shovels to scoop up debris during use and deliver the debris to the capturing surface. In some cases, the twisting of the multiple strands out of plane can increase the ability of a skip-slit sheet to pick up debris during cleaning relative to a skip-slit sheet that is used in a flat configuration (that is, used in its initial state as described above.)

In this application, terms such as "a", "an" and "the" are not intended to refer to only a singular entity, but include the general class of which a specific example may be used for illustration. The terms "a", "an", and "the" are used interchangeably with the term "at least one". The phrases "at least one of" and "comprises at least one of" followed by a list refers to any one of the items in the list and any combination of two or more items in the list. All numerical ranges are inclusive of their endpoints and non-integral values between the endpoints unless otherwise stated.

The above summary of the present disclosure is not intended to describe each disclosed embodiment or every implementation of the present disclosure. The description that follows more particularly exemplifies illustrative embodiments. It is to be understood, therefore, that the following description should not be read in a manner that would unduly limit the scope of this disclosure.

While the above-identified drawings and figures set forth embodiments of the disclosure, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of this invention.

The figures may not be drawn to scale.

DETAILED DESCRIPTION

Figure 1A:
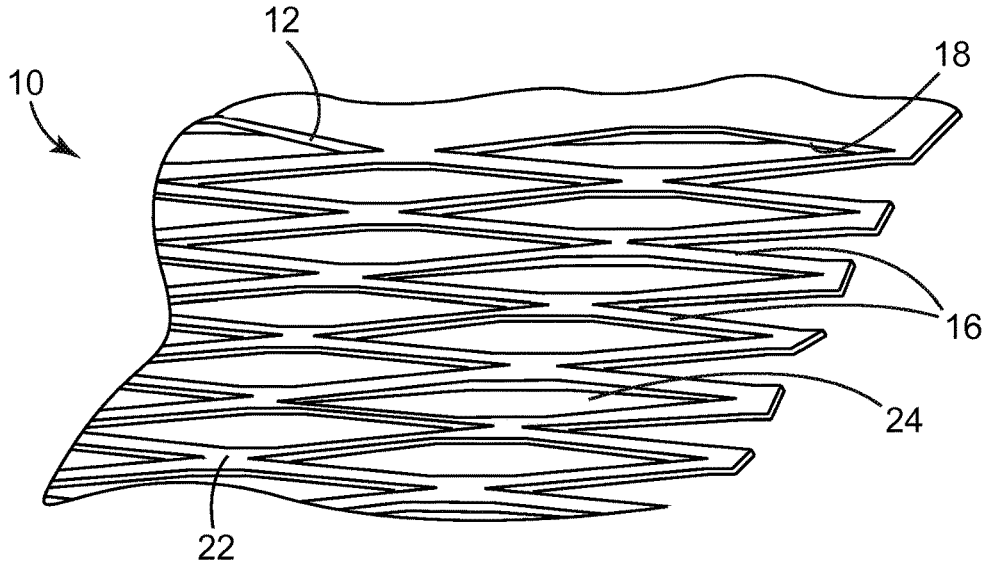
FIG. 1A is a perspective view of a cleaning article according to some embodiments of the present disclosure.
Figure 1B:
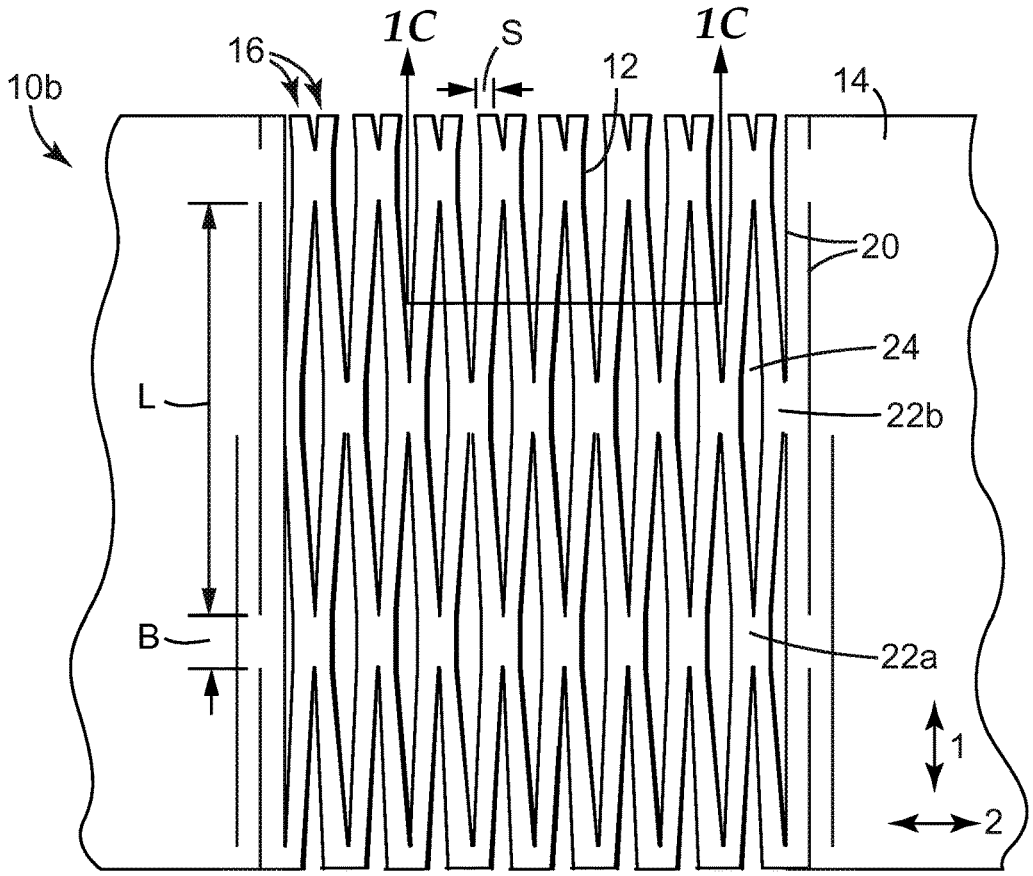
FIG. 1B is a top view of a cleaning article according to some embodiments of the present disclosure.
Figure 1C:
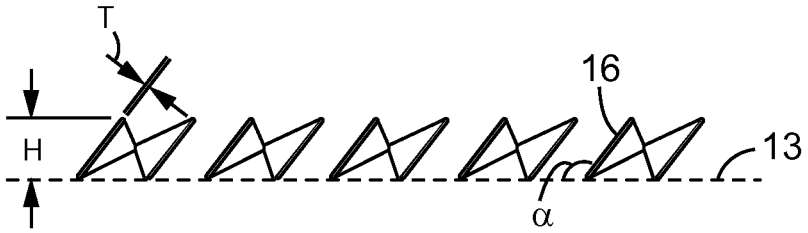
FIG. 1C is a side view taken at line 1C-1C in FIG. 1.

An embodiment of a cleaning article according to the present disclosure is shown in FIG. 1A. Cleaning article 10 has a working surface 12 that includes the first ends of a plurality of channels 24. The plurality of channels 24 are formed from multiple strands 16 of a skip-slit sheet material attached to each other at bridging regions 22 and separated from each other between the bridging regions 22. At least a portion of the strands 16 that are separated from each other are twisted out of plane. The out-of-plane twisting can be seen in FIG. 1B by the thickness of strands 16 of the skip-slit sheet 10*b*, some of which are only visible edge-on in this top view. The out-of-plane twisting may also be seen in the cross sectional view shown in FIG. 1C, which is taken along line 1C-1C in FIG. 1B. As shown in FIG. 1C, strands 16 are twisted out of plane 13 by an angle alpha ($\alpha$).

Figure 1D:
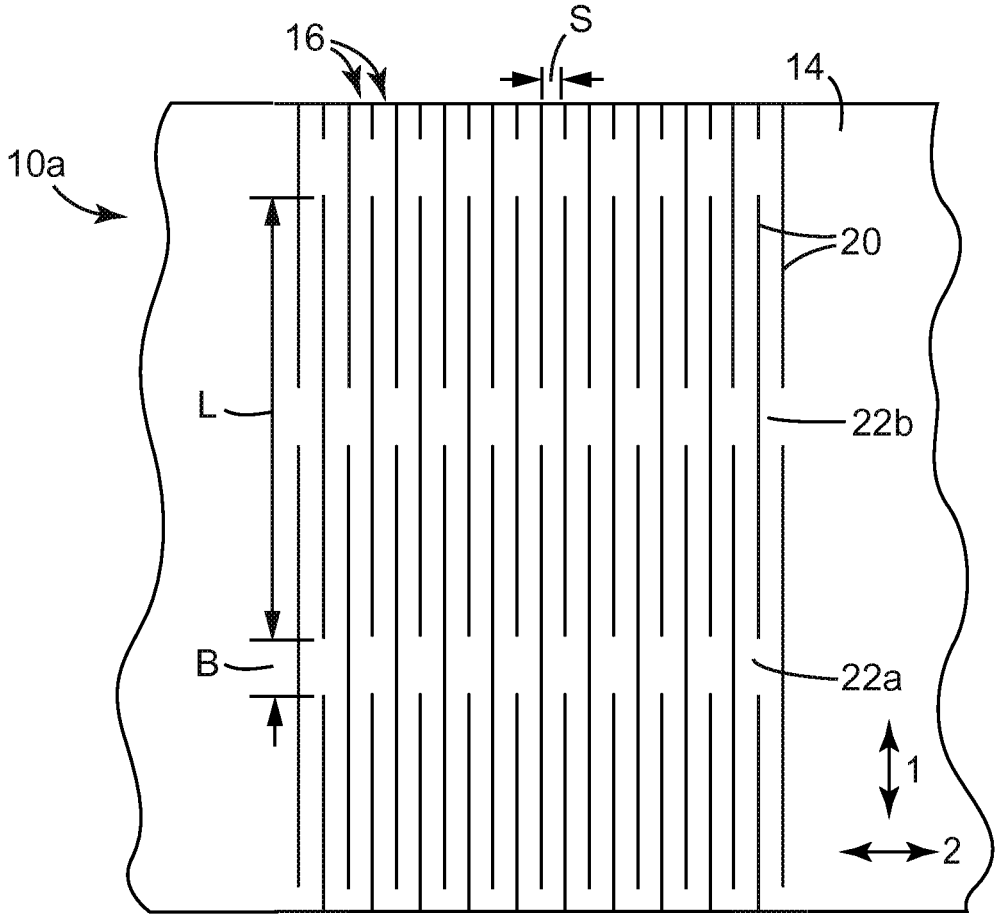
FIG. 1D is a top view of a cleaning article according to some embodiments of the present disclosure in its initial state.

When it is said that at least a portion of the strands 16 that are separated from each other are twisted out of plane, the plane can be understood to be defined by the skip-slit sheet in an initial state 10*a*. An illustration of an initial state 10*a* of a skip-slit sheet similar to that shown in FIGS. 1A and 1B is shown in FIG. 1D. In the initial state 10*a* of the skip-slit sheet, the multiple strands 16 extend in a first direction and together define a plane, shown as 13 in FIG. 1C. The strands are formed by interrupted slits 20 in sheet material 14. The illustrated interrupted slits 20 are linear in the first direction "1". The interrupted slits 20 are interrupted by intact bridging regions 22 of the sheet material 14. The bridging regions 22 are regions where the material 14 is not cut through, and at least a portion of the bridging regions can be considered collinear with interrupted slit 20. In the illustrated embodiment, the interrupted slits 20 are evenly spaced although this is not a requirement. Further, in the illustrated embodiment, the bridging regions 22 are staggered in a second direction 2 perpendicular to the first direction 1 of the interrupted slits 20. The bridging regions 22*a* and 22*b* are staggered such that bridging region 22*b* is located substantially midway between bridging regions 22*a* in the direction "1".

Referring now to FIG. 1C, when a skip-slit sheet useful for practicing the present disclosure is pulled in the second direction, at least a portion of the strands 16 that are separated from each other are twisted out of plane 13. In some embodiments, "at least a portion" refers to at least 25, 50, 75, or 90 percent or more of the multiple strands being twisted out-of-plane. The multiple strands can be twisted out of plane in a range from 10 to 170 degrees. That is, the angle ($\alpha$) as shown in FIG. 1C may be in a range from 10 to 170 degrees. In some embodiments, the angle ($\alpha$) as shown in FIG. 1C may be in a range from 20 to 160 degrees or in a range from 30 to 150 degrees. The twisting out of plane of the multiple strands of the skip-slit sheet is typically readily visible. Transition between the initial state, in which the multiple strands 16 occupy plane 13, and the state in which at least some of the strands are separated from each other and twisted out of plane is typically at least partially reversible, and the out-of-plane twisting can be observed to decrease as the tension on the skip-slit sheet is reduced.

As shown in FIGS. 1A, 1B, and 1D, slits need not be made on the entire skip-slit sheet. There may be unslit portions on the edges of the sheet material 14 as shown in FIGS. 1A, 1B, and 1D and in the center of the sheet as described below in connection with FIGS. 3, 4, and 5. Slits may be provided in any desired location, depending on how the cleaning article will be used. In some embodiments, slits may be provided across 50, 60, 70, 80, or 90 percent of the skip-slit sheet in at least one of the first direction 1 or second direction 2.

A cleaning article according to the present disclosure has a capturing surface. A capturing surface is defined herein as a surface that can at least one of attract or retain debris, for example, dirt, dust, sand, hair, food particles, or other debris. The capturing surface may also be understood to be a surface that is at least one of tacky, electrically charged, or wet. In any of the embodiments of the cleaning article disclosed herein, the capturing surface may be a tacky surface. As described below, tackiness can be provided, for example, through the use of an adhesive, an oil, or a wax.

In some embodiments of the cleaning article illustrated in FIGS. 1A to 1D, the sheet material 14 is capable of capturing dirt, dust, or other debris. In these embodiments, it may be said that at least a portion of the skip-slit sheet 10*b* itself includes the capturing surface. For example, at least a portion of the interior of the channels 18 includes the capturing surface. In these embodiments, the working surface 12, formed by the first ends of the plurality of channels, may also be considered to be a capturing surface.

The skip-slit sheet, and consequently the multiple strands 16, can be formed from a variety of materials. Examples of suitable materials for forming the multiple strands 16 include paper, fibrous materials, thermoplastic films, and combinations thereof. Some paper is commercially available with slits similar to those shown in FIG. 1D. For example, paper available from Geami, Raleigh, N.C., under the trade designation "GEAMI SUSTAINABLE PROTECTIVE PACKAGING" is provided with slits. The fibrous material can include at least one of woven, nonwoven, or knit materials. The nonwoven can be any sheet or web having a structure of individual fibers or threads which are interlaid, but not in an identifiable manner as in a knitted fabric and can be formed from various processes such as meltblowing processes, spunbonding processes, spunlacing processes, and bonded carded web processes. In some embodiments, the material forming the multiple strands is a spunbond nonwoven. Fibrous materials that provide useful cleaning surfaces may be made of natural fibers (e.g., wood or cotton fibers), synthetic fibers (e.g., thermoplastic fibers), or a combination of natural and synthetic fibers. Examples of materials for forming thermoplastic fibers include polyolefins (e.g., polyethylene, polypropylene, polybutylene, ethylene copolymers, propylene copolymers, butylene copolymers, and copolymers and blends of these polymers), polyesters, and polyamides. Useful thermoplastic films include single- or multilayered films, coextruded films, laterally laminated films, or films comprising foam layers. The thermoplastic films can be made from the same thermoplastic materials as the thermoplastic fibers as well as halogenated polymers such as poly(vinyl chloride) and poly(vinylidene chloride), polyesters such as polyethylene terephthalate, polyurethanes, poly(vinyl acetate) and vinyl acetate copolymers. Polypropylene films can include monoaxially oriented polypropylene, biaxially oriented polypropylene, simultaneously biaxially oriented polypropylene, and untensilized polypropylene including untensilized isotactic polypropylene films. In some embodiments, the material forming the multiple strands is a spunbond nonwoven made from at least one of polypropylene or polyethylene fibers.

In some embodiments in which the skip-slit sheet itself includes the capturing surface, the skip-slit sheet comprises adhesive. The adhesive may be applied to the paper, fibrous materials, or thermoplastic films described above. In some embodiments, the material forming the multiple strands includes an adhesive loaded nonwoven. In some embodiments, the material forming the multiple strands is a lofty, tackified nonwoven web such as that described in U.S. Pat. Appl. Pub. No. 2010/0044909 (Haskett et al.). In these embodiments, a tackified, nonwoven web is prepared by applying adhesive to a densified nonwoven web. The densified, tackified web is then rebulked to an open, lofty form by exposing it to a temperature of at least 225° F. (107° C.). Exposing the densified, tackified web to an elevated temperature can be carried out, in some embodiments, by conveying a continuous length of the densified, tackified web through an oven heated to a temperature of at least 350° F. (177° C.) and at a conveyor speed of at least 5 feet (1.5 meters) per minute. Finally, a sheet is formed from the rebulked, tackified web. The rebulked, tackified web may have an increased degree of loftiness as compared to a degree of loftiness of the densified, tackified web before rebulking.

In other embodiments, in which the skip-slit sheet itself includes the capturing surface, the skip-slit sheet comprises a pressure sensitive adhesive. The pressure sensitive adhesive can be applied as a layer, for example, on the paper, fibrous material, or film forming the multiple strands. The pressure sensitive adhesive can be applied as a continuous layer or in a discontinuous or interrupted pattern. Suitable adhesives for the layer of adhesive include hot melt-coated formulations, transfer-coated formulations, solvent-coated formulations, and latex formulations. Preferably, the layer of adhesive is a pressure-sensitive adhesive. General categories of pressure-sensitive adhesives can be based on natural rubber, styrene butadiene, butyl rubber and polyisobutylene, styrenic block copolymers, ethylene-vinyl acetate and related copolymers, poly-alpha olefins, acrylic adhesives, silicone, butadiene-acrylonitrile, polychloroprene, polybutadiene, atactic polypropylene, or repulpable pressure-sensitive adhesive. (From the Handbook of Pressure Sensitive Adhesive Technology, Third Edition, Edited by Donatas Satas, Satas & Associates, 1999.) However, other pressure-sensitive adhesives may be useful, such as those with the properties described in Adhesion and Adhesives Technology an Introduction, p. 216, Alphonsus V. Pocius, Hanser Gardner Publications, Inc., 1997. The Pressure-Sensitive Tape Council has defined pressure-sensitive adhesives as materials with the following properties: 1) aggressive and permanent tack; 2) adheres with no more than finger pressure; 3) requires no activation by any energy source; 4) has sufficient ability to hold onto the adherend; and 5) has enough cohesive strength to be able to be removed cleanly from the adherend.

Examples of adhesives useful for the skip-slit sheet include those based on general compositions of polyacrylates; polyvinyl ethers; diene-containing rubbers such as natural rubber, polyisoprene, and polyisobutylene; polychloroprene; butyl rubber; butadiene-acrylonitrile polymer; thermoplastic elastomers; block copolymers such as styrene-isoprene and styrene-isoprene-styrene block copolymers, styrene-diene type block copolymers such as SBS, SIBS, SEBS, and SEPS, or styrene-ethylene-butylene, hydrogenated SBS, hydrogenated SIS, styrene-ethylene-propylene-styrene, ethylene-propylene-diene polymers, and styrene-butadiene polymer; poly-alpha-olefin; amorphous polyolefins; silicones; ethylene-containing copolymers such as those prepared from ethylene vinyl acetate, ethylacrylate, and ethyl methacrylate; polyurethanes; polyamides; epoxies; polyvinylpyrrolidone and vinylpyrrolidone copolymers; polyesters; and mixtures of the above. Additionally, the adhesives can contain additives such as tackifiers, plasticizers, fillers, antioxidants, stabilizers, pigments, diffusing particles, curatives, fragrance, and solvents. Another example of a suitable pressure sensitive adhesive is a reactivatable (e.g., washable) adhesive such as that described in Int. Pat. Appl. Pub. No. WO 2013/070522 (Tuman et al.). In some of these embodiments, the reactivatable pressure sensitive adhesive is a polymerized composition of precursor components comprising one or more alkyl acrylates monomers, the alkyl groups of which have an average of 4-14 C atoms, at least about 2.0 phr of hydrophobic silica, one or more polymerization initiators, one or more crosslinker compounds, in which the precursor components are essentially free of hydrogen-bonding comonomers (e.g., acrylic acid, methacrylic acid, acrylamides, N-vinyl pyrrolidone, N-vinyl caprolactam, acrylonitrile, and dimethyl aminopropyl methacrylate).

In other embodiments in which the skip-slit sheet itself includes the capturing surface, the skip-slit sheet is electrically charged. Charged materials can increase filtration efficiency by drawing in particles to be filtered using their electrical charge. In some embodiments, the skip-slit sheet is an electret. In some of these embodiments, the skip-slit sheet is a fibrous material. Electret treatment can be carried out by a number of different techniques (e.g., those described in U.S. Pat. No. 5,401,446 (Tsai et al.); U.S. Pat. No. 4,215,682 (Kubik et al.); U.S. Pat. No. 4,375,718 (Wadsworth); U.S. Pat. No. 4,592,815 (Nakao); and U.S. Pat. No. 4,874,659 (Ando)).

The skip-slit sheet may also contain, for example, water, oil, or wax, each of which may render the skip-sheet useful for providing a capturing surface. For example, a cleaning article as shown in FIGS. 1A-1D may be a fibrous material used wet, and the cleaning article may be washed, dried, and reused. A variety of oils and waxes may also be suitable for rendering the skip-slit sheet tacky for capturing debris. Examples of suitable oils and waxes include mineral oil, linseed oil, vegetable shortening, soy wax, and bee's wax.

Figure 2:
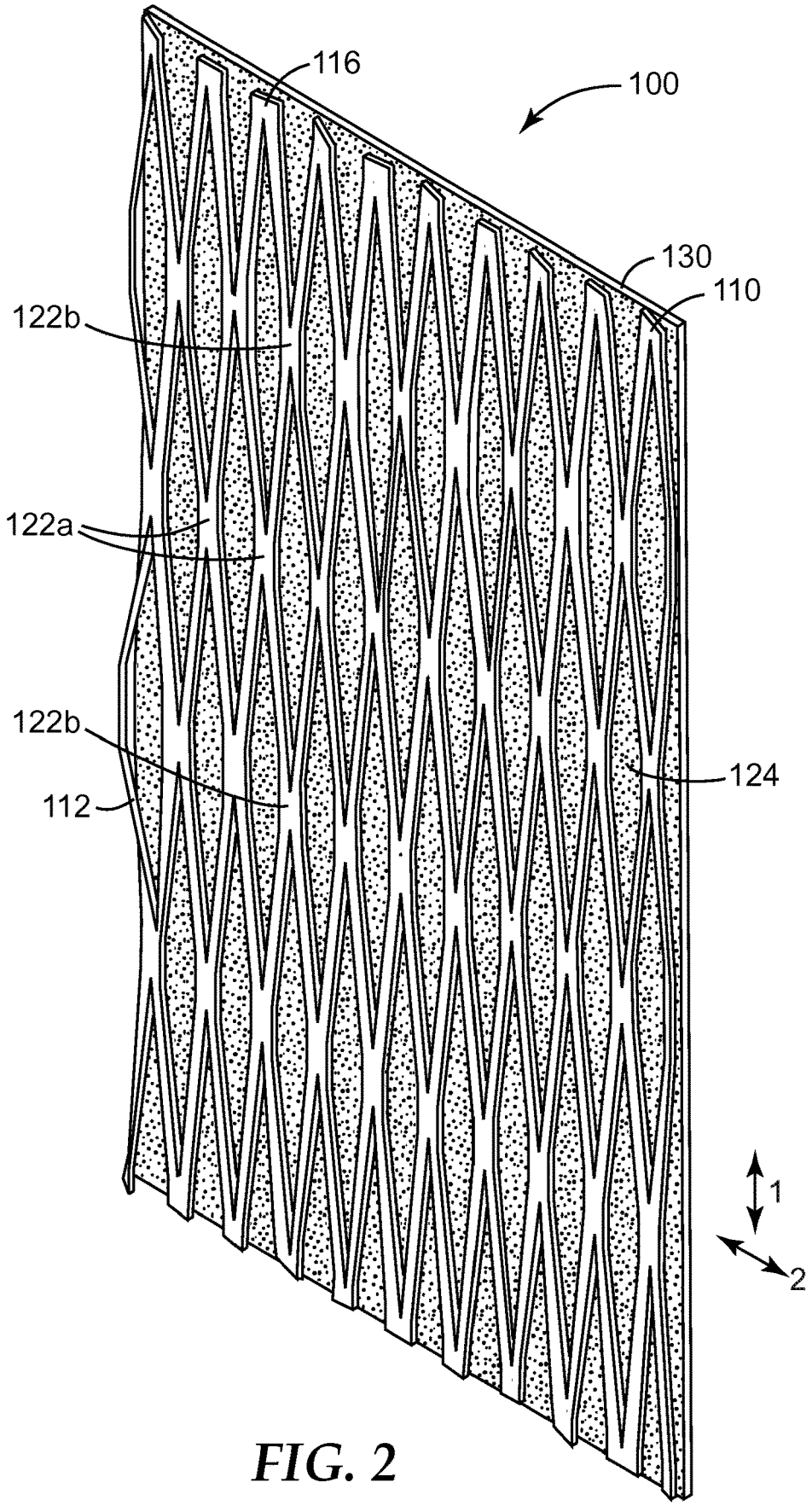
FIG. 2 is a perspective view of another embodiment of a cleaning article according to the present disclosure.

In the embodiment shown in FIG. 2, the cleaning article 100 includes a top layer 110, which includes the working surface, and a separate capturing layer 130 as the bottom layer. Top layer 110 has a working surface 112 that includes the first ends of a plurality of channels 124. The plurality of channels 124 are formed from multiple strands 116 of a material attached to each other at bridging regions **122*a* and 122*b* and separated from each other between the bridging regions. Similar to the embodiment described in connection with FIG. 1A to 1C, in the embodiment illustrated in FIG. 2, the bridging regions are staggered in a second direction 2 perpendicular to the first direction 1. The bridging regions 122*a* and 122*b* are staggered such that bridging region 122*b* is located substantially midway between bridging regions 122*a* in the direction 1. At least a portion of the strands 116** that are separated from each other are twisted out of plane.

In the embodiment illustrated in FIG. 2 and other embodiments in which the capturing surface is included in a separate capturing layer, the top layer 110 can be formed from any of the paper, fibrous materials, and films described above in any of their embodiments. However, in some embodiments, the paper, fibrous material, or thermoplastic film is not provided with adhesive, an electrostatic charge, water, oil, or wax but is useful without such adhesion-promoting additives.

The capturing layer 130 shown in FIG. 2 typically comprises at least one of an adhesive, an electrostatic charge, water, oil, or wax disposed on or within a backing made from any of the paper, fibrous materials, and films described above in any of their embodiments, with the modification that the capturing layer need not be slit and need not have any openings. In some embodiments, the backing of the capturing layer is selected from paper, a woven, a nonwoven (e.g., spunbond polyethylene or polypropylene), and thermoplastic film materials including polyolefins (e.g., polyethylene, polypropylene, or copolymers of ethylene or propylene), halogenated polymers (e.g., poly(vinyl chloride) and poly(vinylidene chloride)), polyesters (e.g., polyethylene terephthalate), polyurethanes, poly(vinyl acetate) and vinyl acetate copolymers. Suitable polypropylene films include monoaxially oriented polypropylene, biaxially oriented polypropylene, simultaneously biaxially oriented polypropylene, and untensilized polypropylene including untensilized isotactic polypropylene. The capturing layer can be compostable or degradable, can be colored, can be printed, can be fragranced, and can be of different surface textures or embossed. The capturing layer 130 may include a textured adhesive surface having raised portions and recessed portions. A textured adhesive surface is described in U.S. Pat. No. 6,865,765 (Aalbers).

In some embodiments, the capturing layer 130 is an adhesive loaded nonwoven. In some embodiments, the capturing layer is a lofty, tackified nonwoven web such as that described in U.S. Pat. Appl. Pub. No. 2010/0044909 (Haskett et al.), which is described in further detail above. In some embodiments, the capturing surface is a pressure sensitive adhesive film, which includes any of the film backings and pressure sensitive adhesives described above in any of their embodiments. The adhesive may be provided in a continuous layer or in a discontinuous or interrupted pattern. In some embodiments, the capturing surface is electrically charged (e.g., an electrically charged nonwoven). In some embodiments, the capturing surface contains water, oil, or wax. For example, a wet fibrous material may be used as a capturing surface. A variety of oils and waxes may be suitable, for example, any of those described above.

Interrupted slits in a sheet material can be formed, for example, using rotary die cutting of a continuous web of material. Interrupted slits can be made, for example, by using rotary cutting blades having gaps to form the bridging regions. The height of the blade in the gaps may be adjusted to allow for the bridging regions to be partially cut or not cut at all, as desired. Other cutting methods (e.g., laser cutting) may also be useful.

While many materials may be slit with the pattern shown in FIG. 1D, not all of such sheets of material will twist out-of-plane when they are spread open. We have found that the ability for the strands 16 to twist out-of-plane depends upon the thickness of the sheet, the length "L" of the slit portions of interrupted slits 20, the length "B" of the bridging regions 22, the distance "S" between slits 20, which is the same as the width of the strand in the second direction 2, and the extent the sheet is spread in the second direction 2. The thickness of the skip-slit sheet, and consequently the thickness "T" of multiple strands 16 as shown in FIG. 1C, is typically up to about 1 mm. In some embodiments, the thickness of the skip-slit sheet or strands may be up to about 400, 250, 150, or 100 micrometers. In some embodiments, the thickness of the skip-slit sheet or strands is in a range from 30 to about 225 micrometers, from about 50 to about 200 micrometers, or from about 100 to about 150 micrometers. The thickness of the skip-slit sheet may be understood to be the dimension perpendicular to plane 13 and also may be understood to be the smallest dimension of the skip-slit sheet and the multiple strands. Various lengths "B" of bridging regions 22 may be useful. In some embodiments, the length of one bridging region in the direction of the interrupted slit is up to 5 mm, 4 mm, 3 mm, 2 mm, or 1.5 mm and at least 0.5 mm, 0.75 mm, or 1 mm. In some embodiments, any bridging regions 22 in a given interrupted slit 20 have a combined length in the first direction 1 of the interrupted slit of up to 50 (in some embodiments, 40, 30, 25, 20, 15, or 10) percent of the length of the interrupted slit. In some embodiments, for maximizing the ability of the sheet in its initial state 10*a* to spread, it may be desirable to minimize the combined length of the bridging regions in the direction of the interrupted slit. In some embodiments, the length of the interrupted slit portion "L" between bridging regions is at least 8 (in some embodiments, at least 9, 10, 11, 12, or 13) mm and may be up to 20 mm or more. In some embodiments, the distance "S" between slits 20, which is the same as the width of the strand in the second direction 2, is at least 1, 1.2, 1.5, 2, or 2.5 mm and may be up to 5 mm or 10 mm. Spreading can be carried out to increase the width of the skip-slit sheet in the second direction to an extent sufficient such that at least some of the strands twist out-of-plane. Increasing the width of the skip-slit sheet by at least 5 percent may be sufficient depending on the thickness of the sheet, the length "L" of the slit portions of interrupted slits 20, the length "B" of the bridging regions 22, the distance "S" between slits 20. In some embodiments, the width of the skip-slit sheet is increased at least 10, 15, 20, 25, 30, 40, or 50 percent. The width of the skip-slit sheet may be increased by up to 100 percent or more. It was found that when a skip-slit sheet having a thickness greater than 1 mm, a length of slit portion "L" of 13 mm, and strand widths "S" and length "B" of the bridging regions of 2 mm, the strands of the skip-slit sheet did not twist out of plane when the sheet was spread in the second direction 2.

Since in many embodiments, the thickness of the skip-slit sheet is smaller than the distance "S" between slits 20, spread the strands 16 apart in the second direction 2 may be considered to effectively provide a height ("H" shown in FIG. 1C) of the skip-slit sheet that is greater than its thickness "T" in its original state. The height of the skip-slit sheet may be considered to be the distance between the working surface and a surface opposite the working surface, comprising second ends of the plurality of channels. In some of these embodiments, depending on the angle ($\alpha$), the height "H" of the skip-slit sheet may be considered to be a length of the channels. A difference between the height "H" of the skip-slit sheet in its spread state and its thickness in its initial state would depend on the thickness of the strand and the angle ($\alpha$) out of the plane 13 of the strands in their initial state. In some embodiments, the height "H" of the skip-slit sheet in its spread state is at least twice the thickness of the skip-slit sheet in its initial state. In some embodiments, the height "H" of the skip-slit sheet in its spread state is at least 3, 4, 5, or 10 times the thickness "T" of the skip-slit sheet in its initial state.

In some embodiments, the cleaning article according to the present disclosure, including the cleaning articles such as those shown in FIGS. 1A and 2, may be used by hand as a wipe. For the embodiment shown in FIGS. 1A to 1D, for example, a user's hand is able to spread the multiple strands 16 to hold open the channels 24 while using the cleaning article as a wipe. In the embodiment shown in FIG. 2, the channels 124 may be held open through the attachment of the top layer 110 to the capturing layer 130. In either of these embodiments, the edges of the strands are available to scoop up debris while the cleaning article is wiped against a surface. It is also envisioned that the cleaning article in either of these embodiments can be incorporated into a mitt that can conveniently fit over a user's hand.

Figure 3:
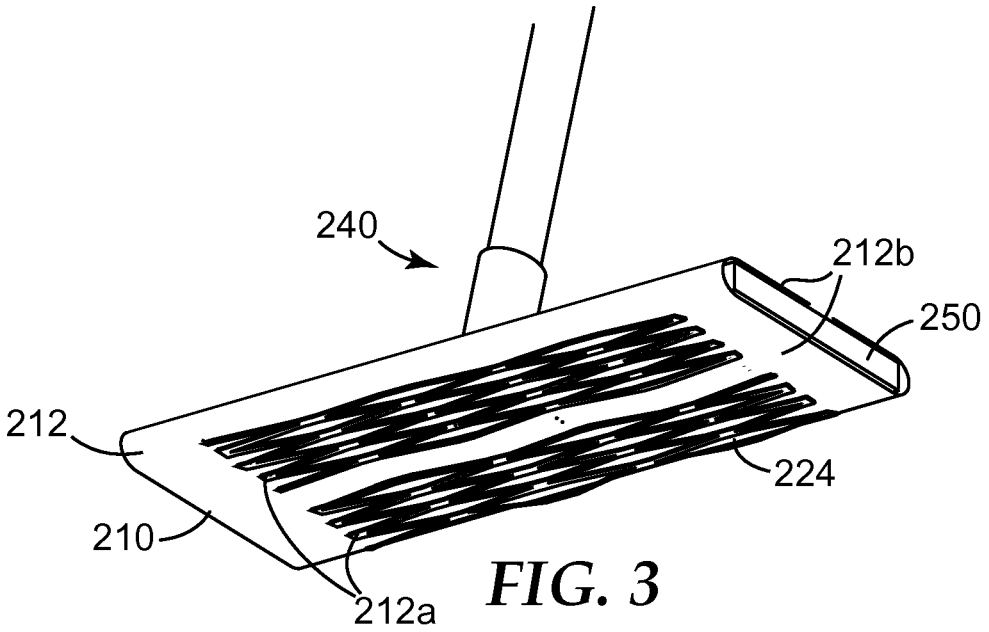
FIG. 3 is a perspective view of an embodiment of a cleaning tool according to the present disclosure.
Figure 4:
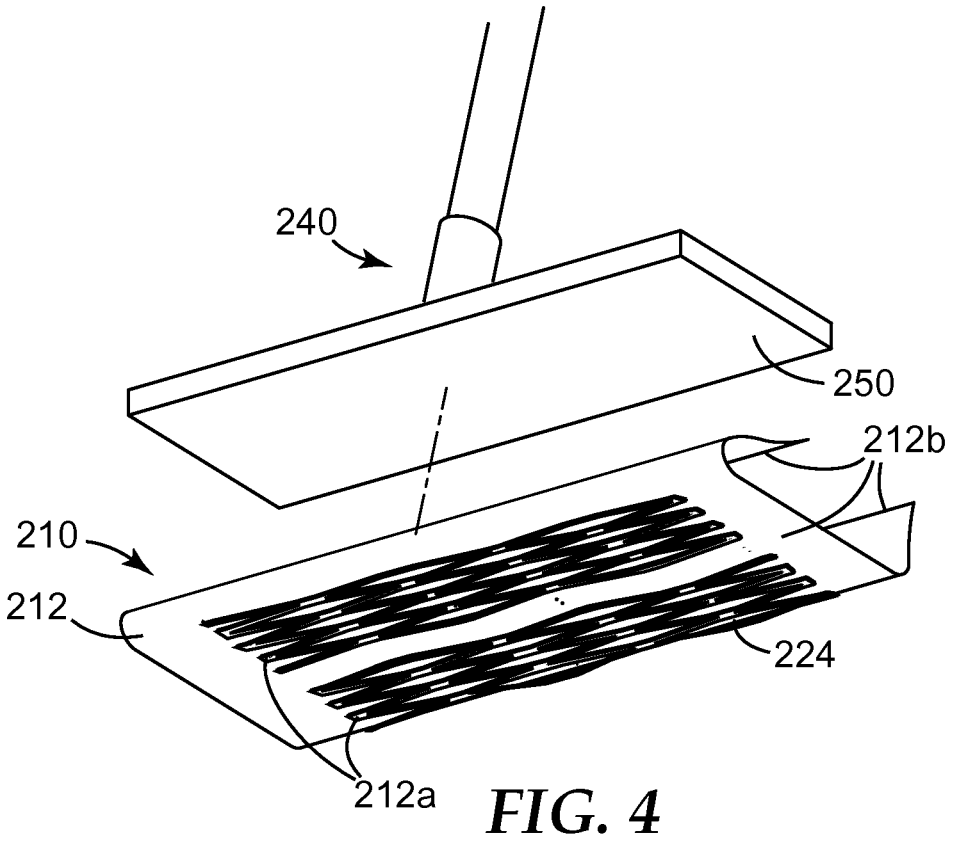
FIG. 4 is an exploded perspective view of the cleaning tool of FIG. 3

In other embodiments, the cleaning article according to the present disclosure may be incorporated into a cleaning tool, for example, attached to a surface of a cleaning tool. In the embodiment shown in FIG. 3, the cleaning article including sheet 210 is attached to a cleaning tool, which is mop 240. FIG. 4 is an exploded perspective view of the cleaning article including sheet 210 and mop 240 of FIG. 3. Sheet 210 can be wrapped around a mop head 250 and attached to the mop head 250 using a variety of convenient methods, for example, pinch points (not shown) on the side of the mop head opposite the working surface. Cleaning article in the form of a sheet 210 has a working surface 212 that includes the first ends of a plurality of channels 224. In the illustrated embodiment, the working surface includes first and second portions 212*a* including channels 224 are formed from multiple strands of a cleaning sheet material attached to each other at bridging regions and separated from each other between the bridging regions as described above in connection with FIGS. 1A to 1D and 2. At least a portion of the strands that are separated from each other are twisted out of plane. The working surface 212 also includes third portions 212*b* that do not include multiple strands with openings between them. The configuration of first and second regions 212*a* and third regions 212*b* in the illustrated embodiment may be useful, for example, for ease of handling of the cleaning sheet and fastening it to the mop head 250. Since most of the cleaning takes place at the edges of the mop, the positioning of the channels 224 at the edges of the mop head 250 as shown may be beneficial. The size of the first and second regions 212*a* and third regions 212*b* may be selected as desired. For example, across the width of the mop head, which is the shorter dimension of the working face, the first region may be about 1.5 inches (3.8 cm) wide, the third region about 1.5 inches (3.8 cm) wide, and the second region about 1.5 inches (3.8 cm) wide. Also, as shown in FIGS. 3 and 4, the slits and resulting channels do not have to reach the lateral edges of the skip-slit sheet. In the illustrated embodiment, the working face and the mop head 250 are rectangular although this is not a requirement. Examples of other possible shapes include square, round, and triangular. The surface to which the sheet 210 is attached may be substantially flat as shown, or it may be textured or have at least one convex or concave portion.

Figure 5:
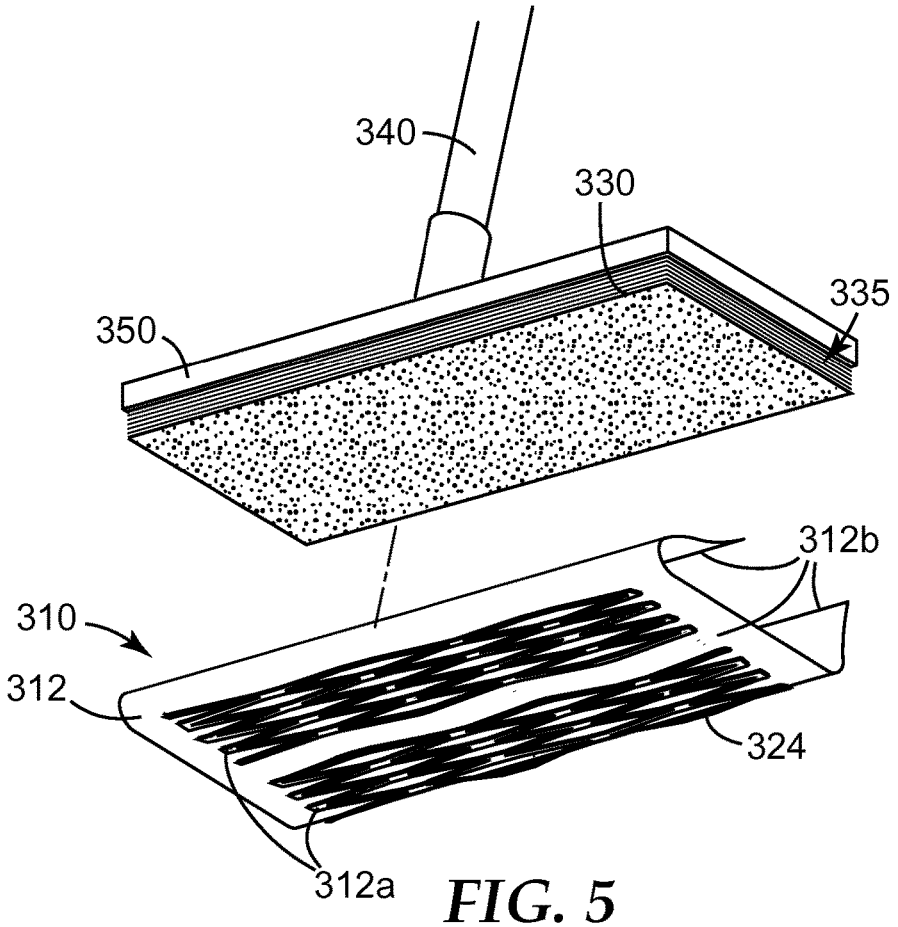
FIG. 5 is an exploded perspective view of a mop having a plurality of layers of a capturing surface.

The mop head 250 may have an adhesive sheet on its surface, which is useful as a capturing layer for mop 240 used in conjunction with skip-slit sheet 210. It may be useful to have a stack 335 of capturing layers such as that shown in FIG. 5. In FIG. 5, plurality of adhesive sheets 330 are stacked one on top of the other such that the adhesive on one adhesive sheet 330 contacts the top surface of a subsequent adhesive sheet 330 to form a stack 335. In some embodiments the top surface of the adhesive sheet 330 may include a release treatment such as flame treatment, corona treatment, roughening, release liner, or release coatings (e.g., silicones, fluorochemicals, acrylates, polyurethanes, and polyvinylacetates that can be cured via thermal, ultraviolet, or electron beam mechanisms) to facilitate removal from the adhesive sheet above it or to facilitate removal from the mop head 350. The stack 335 is attached to the working surface of the mop 340, and skip-slit sheet 310 can be stretched over the working surface of mop 340. Sheet 310 has a working surface 312 that includes the first ends of a plurality of channels 324. In the illustrated embodiment, the working surface includes first and second portions 312*a* including channels 324 are formed from multiple strands of a cleaning sheet material attached to each other at bridging regions and separated from each other between the bridging regions as described above in connection with FIGS. 1A to 1D and 2. The working surface 312 also includes third portions 312*b* that do not include multiple strands with openings between them.

In the method of making a cleaning tool according to the present disclosure, the skip-slit sheet is spread in the second direction to provide multiple strands of the skip-slit sheet separated from each other between the intact bridging regions and attached to the surface of the cleaning tool such that at least a portion of the multiple strands that are separated from each other are twisted out of the plane defined by the skip-slit sheet before it is spread in the second direction. The spreading of the skip-slit sheet in the second direction can be carried out before it is attached to the surface of the cleaning tool or during the attachment. For example, the skip-slit sheet may be attached at one end to the cleaning tool and then stretched in the second direction to form the channels. The other end of the skip-slit sheet may then be attached to the cleaning tool. In some embodiments, the cleaning tool can be assembled in this manner by the user. The features of the skip-slit sheets in the stack may be any of those described above in connection with FIG. 1D.

Figure 6:
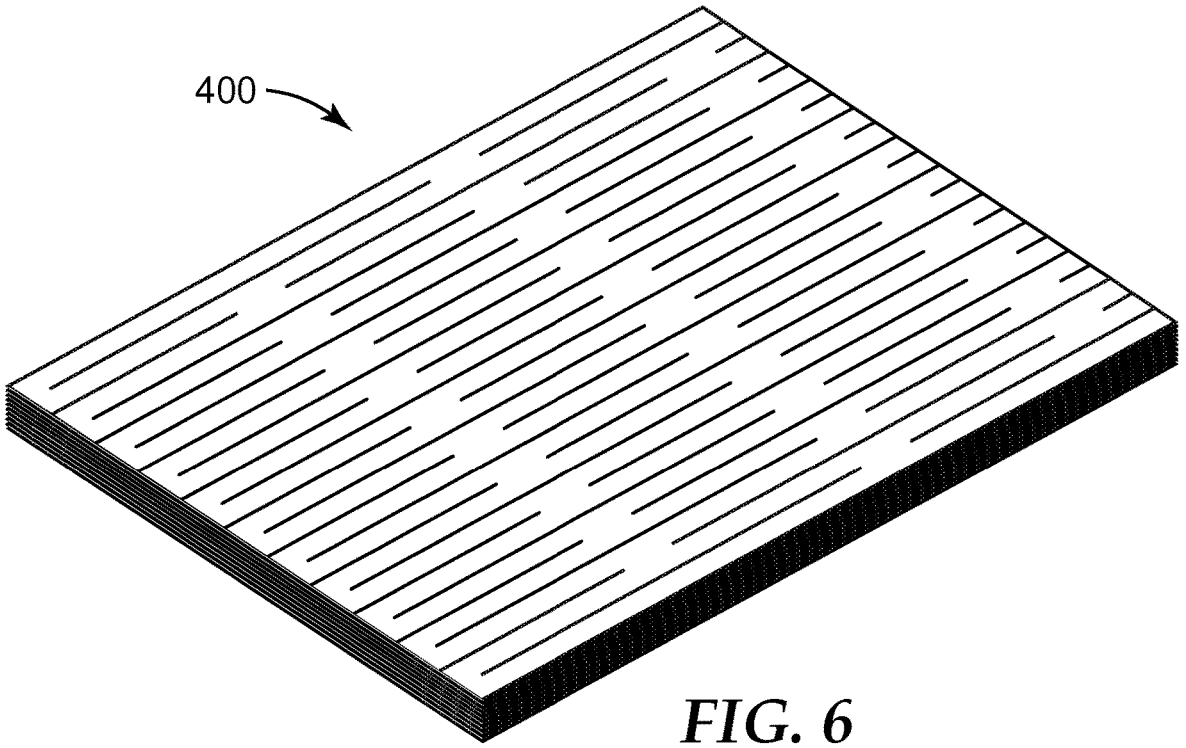
FIG. 6 is perspective view of a stack of skip-slit sheets, useful in the cleaning article according to the present disclosure.

Components of the cleaning sheet or cleaning tool according to the present disclosure may be either disposable or reusable. For example, as shown in FIG. 5, the capturing layers, adhesive sheets 330, in the stack 335 of capturing layers can conveniently be disposable, and the skip-slit sheet may be reusable or disposable. Once a capturing layer (that is, adhesive sheet 330) is dirty, a user can remove skip-slit sheet 310 from the mop head 350, remove the dirty adhesive sheet 330, and then either replace the skip-slit sheet 310 if it is reusable or apply a new, clean skip-slit sheet 310 to the mop head. An adhesive sheet applied to mop head 350 may alternatively be washable. For example, it could be a reactivatable (e.g., washable) adhesive as described above, or it could be a fibrous material (e.g., cloth) that can be used when damp. In some embodiments, the skip-slit sheet is disposable. Referring now to FIG. 6, a user may conveniently have a stack 400 of skip-slit sheets available that can be applied one-at-a-time to mop head 250 or 350 and disposed of when they are dirty. In some embodiments, the stack 400 is a stack of skip-slit spunbond nonwoven sheets each having a plurality of interrupted slits that are interrupted by intact bridging regions in the cleaning sheet, wherein the interrupted slits extend in a first direction, and wherein the intact bridging regions are staggered in a second direction transverse to the first direction.

As shown in the Examples, below, in some cases, the twisting of the multiple strands out of plane can increase the ability of a skip-slit sheet to retain debris after cleaning relative to a skip-slit sheet that is used in a flat configuration (that is, used in its initial state as described above.) For example, when the skip-slit sheet is made from paper or a spunbond nonwoven, there was an increase in the amount of debris retained when the skip-slit sheet was spread to allow out-of-plane twisting. In the case of the spunbond nonwoven sheet, the amount of debris retained in a spread skip-slit sheet was a surprising 10% greater than when the skip-slit sheet was used in a flat configuration. The combination of a skit slit nonwoven sheet in which the multiple strands of the sheet are twisted out of plane and a capturing layer in the form of an adhesive tape retained 76% of the debris in the evaluation described below. Although a lofty, adhesive loaded nonwoven sheet also provided excellent results in the Debris Removal Evaluation, the combination of a flat skip-slit sheet and an adhesive capturing layer provides an inexpensive but surprisingly effective means of removing debris. Staple fiber webs and secondary processes such as hydroentangling are not required for the skip-slit sheet; therefore, such expensive and time-consuming processes can be avoided.

SOME EMBODIMENTS OF THE DISCLOSURE

In a first embodiment, the present disclosure provides a cleaning article comprising:

a working surface comprising first ends of a plurality of channels; and a capturing surface, wherein the plurality of channels are formed from multiple strands of a skip-slit sheet, wherein in an initial state, the multiple strands extend in a first direction and together define a plane, wherein the multiple strands are attached to each other at bridging regions that are staggered in a second direction transverse to the first direction, wherein at least some of the strands are spread from the initial state and separated from each other between the bridging regions to provide the plurality of channels, and wherein at least some of the multiple strands that are separated from each other are twisted out of the plane. The capturing surface typically is included in at least one of a capturing layer opposite the working surface or within a portion of the interior of the channels.

In a second embodiment, the present disclosure provides the cleaning article of the first embodiment, wherein the capturing surface comprises at least one of an adhesive, an electrostatic charge, water, oil, or wax.

In a third embodiment, the present disclosure provides the cleaning article of the first or second embodiment, wherein at least one of the working surface or the capturing surface is reusable.

In a fourth embodiment, the present disclosure provides the cleaning article of any one of the first to third embodiments, wherein a capturing layer opposite the working surface comprises the capturing surface.

In a fifth embodiment, the present disclosure provides the cleaning article of any one of the first to fourth embodiments, wherein the skip-slit sheet and consequently the material forming the multiple strands comprises at least one of paper, fibrous material, or thermoplastic film.

In a sixth embodiment, the present disclosure provides the cleaning article of the fifth embodiment, wherein the skip-slit sheet and consequently the material forming the multiple strands comprises a spunbond nonwoven.

In a seventh embodiment, the present disclosure provides the cleaning article of any one of the fourth to sixth embodiments, wherein the capturing layer is an adhesive film.

In an eighth embodiment, the present disclosure provides the cleaning article of any one of the first to third embodiments, wherein at least a portion of the interior of the plurality of channels comprises the capturing surface.

In a ninth embodiment, the present disclosure provides the cleaning article of the eighth embodiment, wherein the material forming the multiple strands comprises an adhesive-loaded nonwoven.

In a tenth embodiment, the present disclosure provides the cleaning article of the seventh or ninth embodiment, wherein the adhesive is a washable adhesive.

In an eleventh embodiment, the present disclosure provides the cleaning article of any one of the first to tenth embodiments, wherein the strands that are twisted out of the plane have an angle to the plane in a range from ten degrees to 170 degrees.

In a twelfth embodiment, the present disclosure provides the cleaning article of any one of the first to eleventh embodiments, wherein the strands that are twisted out of the plane have an angle to the plane in a range from ten degrees to 170 degrees.

In a thirteenth embodiment, the present disclosure provides the cleaning article of any one of the first to twelfth embodiments, wherein the multiple strands each have a thickness of up to one millimeter.

In a fourteenth embodiment, the present disclosure provides the cleaning article of any one of the first to thirteenth embodiments, wherein any bridging region has a length in the first direction of up to 5 millimeters.

In a fifteenth embodiment, the present disclosure provides the cleaning article of any one of the first to fourteenth embodiments, wherein a slit length in a first direction between any two bridging regions is at least 8 millimeters.

In a sixteenth embodiment, the present disclosure provides the cleaning article of any one of the first to fifteenth embodiments, wherein at least some of the multiple strands have a width in the second direction in a range from one millimeter to 5 millimeters.

In a seventeenth embodiment, the present disclosure provides the cleaning article of any one of the first to sixteenth embodiments, wherein the skip-slit sheet has a height measured from the working surface to an opposing surface comprising second ends of the plurality of channels, and wherein the height is at least twice the thickness of the skip-slit sheet in the initial state.

In an eighteenth embodiment, the present disclosure provides a cleaning tool comprising a surface and the cleaning article of any one of the first to seventeenth embodiments attached to the surface of the cleaning tool.

In a nineteenth embodiment, the present disclosure provides the cleaning tool of the eighteenth embodiment, wherein the cleaning tool is a mop head.

In a twentieth embodiment, the present disclosure provides the cleaning tool of the eighteenth or nineteenth embodiment, wherein the surface of the cleaning tool is substantially flat.

In a twenty-first embodiment, the present disclosure provides a method of making a cleaning tool, the method comprising:

providing a skip-slit sheet having a plurality of interrupted slits that are interrupted by intact bridging regions in the skip-slit sheet, wherein the interrupted slits extend in a first direction, wherein the intact bridging regions are staggered in a second direction transverse to the first direction, and wherein the skip-slit sheet defines a plane;

providing a cleaning tool having a surface;

spreading the skip-slit sheet in the second direction to provide multiple strands of the skip-slit sheet separated from each other between the intact bridging regions; and attaching the multiple strands to the surface of the cleaning tool such that at least some of the multiple strands that are separated from each other are twisted out of the plane defined by the skip-slit sheet before it is spread in the second direction.

In a twenty-second embodiment, the present disclosure provides the method of the twenty-first embodiment, wherein a capturing layer is interposed between the surface of the cleaning tool and the multiple strands.

In a twenty-third embodiment, the present disclosure provides the method of the twenty-first or twenty-second embodiment, wherein the capturing layer comprises at least one of an adhesive, an electrostatic charge, water, oil, or wax.

In a twenty-fourth embodiment, the present disclosure provides the method of the twenty-third embodiment, wherein the capturing layer is an adhesive film.

In a twenty-fifth embodiment, the present disclosure provides the method of any one of the twenty-first to twenty-fourth embodiments, wherein the skip-slit sheet comprises at least one of paper, fibrous material, or thermoplastic film.

In a twenty-sixth embodiment, the present disclosure provides the method of the twenty-fifth embodiment, wherein the skip-slit sheet comprises a spunbond nonwoven.

In a twenty-seventh embodiment, the present disclosure provides the method of any one of the twenty-first to twenty-sixth embodiments, wherein the skip-slit sheet comprises at least one of an adhesive, an electrostatic charge, water, oil, or wax.

In a twenty-eighth embodiment, the present disclosure provides a stack of skip-slit spunbond nonwoven sheets each having a plurality of interrupted slits that are interrupted by intact bridging regions, wherein the plurality of interrupted slits extend in a first direction, and wherein the intact bridging regions are staggered in a second direction transverse to the first direction.

In a twenty-ninth embodiment, the present disclosure provides the stack of the twenty-eighth embodiment, wherein each spunbond nonwoven sheet has a thickness of less than one millimeter.

In a thirtieth embodiment, the present disclosure provides the stack of the twenty-ninth embodiment, wherein any bridging region has a length in the first direction of up to 5 millimeters.

In a thirty-first embodiment, the present disclosure provides the stack of the twenty-ninth or thirtieth embodiment, wherein for at least some of the interrupted slits, a length of a slit portion in the first direction between any two bridging regions is at least 8 millimeters.

In a thirty-second embodiment, the present disclosure provides the stack of any one of the twenty-ninth to thirty-first embodiments, wherein a distance between the interrupted slits in the second direction is in a range from one millimeter to 5 millimeters.

In a thirty-third embodiment, the present disclosure provides the stack of any one of the twenty-ninth to thirty-second embodiments, wherein when a spunbond nonwoven sheet from the stack is spread in the second direction, multiple strands are attached to each other at the bridging regions, and at least a portion of the multiple strands separate from each other and are twisted out of the plane defined by the skip-slit sheet before it is spread in the second direction.

EXAMPLES

Features and advantages of the present disclosure are further illustrated in the following Examples. It is to be expressly understood, however, that the particular materials and amounts used, as well as other conditions and details are not to be construed in a manner that would unduly limit the scope of this disclosure.

In the following examples, Sheet 1 was paper obtained from Geami, Raleigh, N.C., under the trade designation "GEAMI SUSTAINABLE PROTECTIVE PACKAGING" The paper as obtained had a slit length "L" of 10 millimeters (mm), a distance between slits "S" of 3 mm, and a length of bridging regions "B" of 5 mm (refer to FIG. 1D). Sheet 2 was a spunbond nonwoven having a basis weight of 45 grams per square meter obtained from Fiberweb, Old Hickory, Tenn. Sheet 3 was a bumpy, hydroentangled nonwoven having a basis weight of 65 grams per square meter. The original flat hydroentangled nonwoven was obtained from Ahlstrom, Windsor Locks, Conn. and corrugated with bumps that were 3 mm in diameter by 1 mm in height in accordance to U.S. Pat. No. 5,904,793 (Gorman et al.). Sheet 4 was a lofty, adhesive-loaded nonwoven having a basis weight of 60 grams per square meter prepared according to the method of Example 1 in U.S. Pat. App. Pub. No. 2010/044909 (Haskett et al.).

Sheets 2 to 4 were provided with a pattern of slits with a slit length "L" of 13 mm, a distance between slits "S" of 2 mm, and a length of bridging regions "B" of 2 mm (refer to FIG. 1D). This was carried out with a 4-inch (10.2-centimeter (cm)) by 4-inch (10.2-cm) rule die. The rule die was carefully aligned in adjacent positions to achieve longer samples.

Debris Removal Evaluation

Sand and dust removal was measured by distributing a mixture of 1.15 gram combined weight sand (75-150 micrometer mean diameter), JIS dust, and pet hair in a ratio of 100:15:5, sand:dust:hair on the surface of a square piece of linoleum measuring 4 feet (1.2 meters (m)) by 4 feet (1.2 m). The combined weight of the sand, dust, and pet hair is collectively designated as $W_1$, below. Each of Sheets 1 to 5 was weighed, and the weight was recorded as $W_2$. Each sheet was then individually attached to a flat head of a mop available from The Procter & Gamble Company, Cincinnati, Ohio, under the trade designation "SWIFFER SWEEPER" by pushing it into the poke holes provided on the "SWIFFER SWEEPER" mop head. The mop head was attached to the mop handle. The test sample was first pushed and pulled twice over the entire flooring area (i.e., two passes over every area of the flooring that had sand and dust on it) with minimal pressure applied to the handle of the mop, and then pushed around the edge of the flooring area in a counter-clockwise motion, turning the mop head at the corners. The test sample cloth was then carefully removed from the handle and its weight was measured ($W_3$). The weight percent of the sand, dust, and hair removed by the test sample from the surface was calculated as follows:

$$\%\ \text{debris removed}=[(W_3-W_2)/W_1]\times 100.$$

For Control Examples A to D, each sheet was evaluated using the Debris Removal Evaluation described above without stretching it to form channels at the working surface. For these Control Examples, each sheet after being attached to the mop head had an appearance similar to FIG. 1D. For Examples 1 to 4, each sheet was stretched to increase its width in the second direction 2 by approximately 50% before attaching it to the mop head so that strands in each sheet were twisted out of plane to form channels at the working surface. For these Examples, each sheet after being attached to the mop head had an appearance similar to FIGS. 1A and 1B. For Examples 5 to 8, lint tape from a lint roller obtained from 3M Company, St. Paul, Minn under the trade designation "SCOTCH LINT ROLLER" was attached to the mop head using double sided adhesive tape before each of Sheets 1 to 4 was attached. Each sheet was then attached to the mop over the lint sheet after stretching it to increase its width in the second direction 2 by approximately 50% so that strands in each sheet were twisted out of plane to form channels at the working surface. For each of Control Examples A to D and Examples 1 to 8, the Debris Removal Evaluation was carried out one to three times. The average percent debris removed, calculated as described above, is shown in the Table, below.

TABLE

| Sheet | Control Example, percent debris removed | Example, percent debris removed | Example, percent debris removed |
|---|---|---|---|
| 1 | C.E. A, 1% | Ex. 1, 3 | Ex. 5, 29% |
| 2 | C.E. B, 7% | Ex. 2, 17% | Ex. 6, 76% |
| 3 | C.E. C, 13% | Ex. 3, 13% | Ex. 7, 54% |
| 4 | C.E. D, 95% | Ex. 4, 94% | Ex. 8, 95% |

Although specific embodiments have been shown and described herein, it is understood that these embodiments are merely illustrative of the many possible specific arrangements that can be devised in application of the principles of the invention. Numerous and varies other arrangements can be devised in accordance with these principles by those of ordinary skill in the art without departing from the sprit and scope of the invention. The scope of the present invention should not be limited to the structures described in this application, but only by the structures described by the language of the claims and the equivalents of those structures.

What is claimed is:

1. A cleaning article comprising:

a working surface comprising first ends of a plurality of channels; and a capturing layer opposite the working surface, the capturing layer comprising a capturing surface, wherein the capturing layer is not slit, wherein the plurality of channels are formed from multiple strands of a skip-slit sheet comprising interrupted slits that are interrupted by intact bridging regions, wherein in an initial state the multiple strands and the interrupted slits extend in the first direction and together define a plane, wherein the multiple strands are attached to each other at the intact bridging regions that are staggered in a second direction transverse to the first direction, wherein at least some of the multiple strands are spread from the initial state and separated from each other between the intact bridging regions to provide the plurality of channels, and wherein at least some of the multiple strands that are separated from each other are twisted out of the plane and have an angle to the plane in a range from 10 degrees to 170 degrees.

2. The cleaning article of claim 1, wherein the capturing surface comprises at least one of an adhesive, an electrostatic charge, water, oil, or wax.

3. The cleaning article of claim 1, wherein at least one of the working surface or the capturing surface is reusable.

4. The cleaning article of claim 1, wherein the skip-slit sheet comprises at least one of paper, fibrous material, or thermoplastic film.

5. The cleaning article of claim 4, wherein the skip-slit sheet comprises a spunbond nonwoven.

6. The cleaning article of claim 1, wherein the capturing layer is an adhesive film.

7. The cleaning article of claim 6, wherein the adhesive is a washable adhesive.

8. The cleaning article of claim 1, wherein the skip-slit sheet comprises an adhesive-loaded nonwoven.

9. The cleaning article of claim 1, wherein the multiple strands each have a thickness of up to one millimeter.

10. The cleaning article of claim 1, wherein any bridging region has a length in the first direction of up to 5 millimeters.

11. The cleaning article of claim 1, wherein a slit length in a first direction between any two bridging regions is at least 8 millimeters.

12. The cleaning article of claim 1, wherein at least some of the multiple strands have a width in the second direction in a range from one millimeter to 5 millimeters.

13. A cleaning tool comprising a surface and the cleaning article of claim 1 attached to the surface, wherein the capturing layer is interposed between the surface of the cleaning tool and the multiple strands of the skip-slit sheet.

14. The cleaning tool of claim 13, wherein the cleaning tool is a mop head.

15. The cleaning tool of claim 13, wherein the capturing layer comprises at least one of an adhesive, an electrostatic charge, water, oil, or wax.

16. The cleaning tool of claim 13, wherein the capturing layer is an adhesive film.

17. The cleaning tool of claim 13, wherein the skip-slit sheet comprises at least one of paper, fibrous material, or thermoplastic film.

18. The cleaning tool of claim 13, wherein the skip-slit sheet comprises a spunbond nonwoven.

19. A method of making the cleaning tool of claim 13, the method comprising:

providing the skip-slit sheet having a plurality of the interrupted slits that are interrupted by the intact bridging regions in the skip-slit sheet, wherein the plurality of the interrupted slits extend in the first direction, wherein the intact bridging regions are staggered in the second direction transverse to the first direction, and wherein the skip-slit sheet defines the plane;

providing the cleaning tool having the surface;

spreading the skip-slit sheet in the second direction to provide the multiple strands of the skip-slit sheet separated from each other between the intact bridging regions; and attaching the multiple strands to the surface of the cleaning tool such that at least some of the multiple strands that are separated from each other are twisted out of the plane defined by the skip-slit sheet before it is spread in the second direction.

20. A cleaning article comprising:

a capturing layer comprising a capturing surface and an opposing surface, wherein the capturing layer is not slit; and a working surface on the capturing surface but not the opposing surface, the working surface comprising first ends of a plurality of channels, wherein the plurality of channels are formed from multiple strands of a skip-slit sheet, wherein in an initial state the multiple strands extend in a first direction and together define a plane, wherein the multiple strands are attached to each other at bridging regions that are staggered in a second direction transverse to the first direction, wherein at least some of the multiple strands are spread from the initial state and separated from each other between the bridging regions to provide the plurality of channels, wherein at least some of the multiple strands that are separated from each other are twisted out of the plane have an angle to the plane in a range from 10 degrees to 170 degrees, and wherein at least one of the following is true:

wherein any bridging region has a length in the first direction of up to 5 millimeters, wherein a slit length in a first direction between any two bridging regions is at least 8 millimeters, or wherein at least some of the multiple strands have a width in the second direction in a range from one millimeter to 5 millimeters.

* * * * *